US006116917A

United States Patent [19]

Choy

[11] Patent Number: 6,116,917

[45] Date of Patent: Sep. 12, 2000

[54] CONNECTOR WITH FLOATING SPACER

[75] Inventor: Edmond Choy, Union City, Calif.

[73] Assignee: Hon Hai Precision Ind. Co., Ltd., Taipei Hsien, Taiwan

[21] Appl. No.: 09/044,390

[22] Filed: Mar. 18, 1998

[51] Int. Cl.[7] ..... H01R 9/09

[52] U.S. Cl. ..... 439/79

[58] Field of Search ..... 439/79, 608, 637, 439/571, 572, 892

[56] References Cited

U.S. PATENT DOCUMENTS

| | | | |
|---|---|---|---|
| 5,133,679 | 7/1992 | Fusselman et al. | 439/608 |
| 5,135,405 | 8/1992 | Fusselman et al. | 439/608 |
| 5,348,488 | 9/1994 | Creen et al. | 439/140 |
| 5,468,154 | 11/1995 | Yip et al. | 439/79 |
| 5,540,598 | 7/1996 | Davis | 439/79 |
| 5,591,036 | 1/1997 | Doi et al. | 439/79 |

*Primary Examiner*—Neil Abrams
*Assistant Examiner*—Hae Moon Hyeon

[57] ABSTRACT

An electrical connector (10) includes an insulative housing (12) defining a central slot (14) for receiving a card therein. A plurality of contacts (16) are disposed by two sides of the central slot (14) for engagement with the corresponding circuit pads on the card. A floating spacer (22) is positioned on a rear portion of the housing without any latch devices fixedly fastening the spacer (22) to the housing (12). A plurality of convex bumps (25) are provided on the bottom surface (26) of the spacer (22) so that when the connector (10) is mounted to the PC board (100), the spacer (22) may generally seated on the PC board (100) due to gravity thereof, and the convex bumps (25) thereof provide a proper space between the spacer (22) and the PC board (100) for allowing the cleaning solution to escape therefrom.

4 Claims, 5 Drawing Sheets

CONNECTOR WITH FLOATING SPACER

BACKGROUND OF THE INVENTION

1. Field of the Invention

The invention relates to the electrical connector with a spacer thereof for alignment of the contact tails, and particularly to the floating type spacer with bumps on the bottom surface thereof.

2. The Related Art

The spacer is designedly used in the electrical connector for alignment of the contact tails so that the tips of the contact tails can be correctly inserted into the corresponding holes in the PC board on which the connector is mounted. As disclosed in U.S. Pat. Nos. 5,601,438 and 5,709,556, each of most spacers used with the connectors includes the plate with several through-holes therein and fastened to the connector housing by means of retaining latch devices generally positioned at two ends of the plate. For some connectors, the dimension thereof is small and either the housing or the spacer is so tiny and/or thin, needless to say the retaining latch devices on the spacer as well. Thus, it is understood that such tiny structures of either the housing or the spacer/latch devices, tend to be broken under some improper impacts during transportation. Once the latch device is damaged, the spacer may be tilted under the condition that one end is well latched to the housing while the other end is cracked and loses its true position with regard to the housing. Understandably, the tilted spacer causes wrong positions of the tips of the contact tails.

Additionally, the latch devices are generally provided at two ends of the spacer. For the general spacer whose dimensions are not so small, this structure is acceptable. Differently, for a thinner and slender spacer, the application of the traditional spacer having the latch devices at two ends may performs as a beam having two simple supports at two opposite ends from a mechanical viewpoint, and thus the middle portion of the plate may be somewhat deflected downward due to either the gravity thereof or the tolerance between the spacer and the housing.

Therefore, to a thinner and slender spacer, it is improper to use the traditional fixed device for combine the housing and the spacer. An object of the invention is to provide a floating spacer for use with the connector housing, which can generally maintain a horizontal manner with regard to the housing and hold the contact tails in true positions.

Additionally, the floating spacer may closely positioned on the PC board due to gravity when the connector is mounted on the PC board, thus resulting in difficulties to remove the cleaning solution between the bottom surface of the spacer and the top surface of the PC board during the soldering procedure, due to surface tension of the cleaning solution. Therefore, another object of the invention is to provide a device of the spacer to maintain a space between the bottom surface of the spacer and the top surface of the PC board on which the connector is mounted.

SUMMARY OF THE INVENTION

According to an aspect of the invention, an electrical connector includes an insulative housing defining a central slot for receiving a card therein. A plurality of contacts are disposed by two sides of the central slot for engagement with the corresponding circuit pads on the card. A floating spacer is positioned on a rear portion of the housing without any latch devices fixedly fastening the spacer to the housing. A plurality of convex bumps are provided on the bottom surface of the spacer so that when the connector is mounted to the PC board, the spacer may generally seated on the PC board due to gravity thereof, and the convex bumps thereof provide a proper space between the spacer and the PC board for allowing the cleaning solution to escape therefrom.

DETAILED DESCRIPTION OF THE PREFERRED EMBODIMENTS

Figure 1:
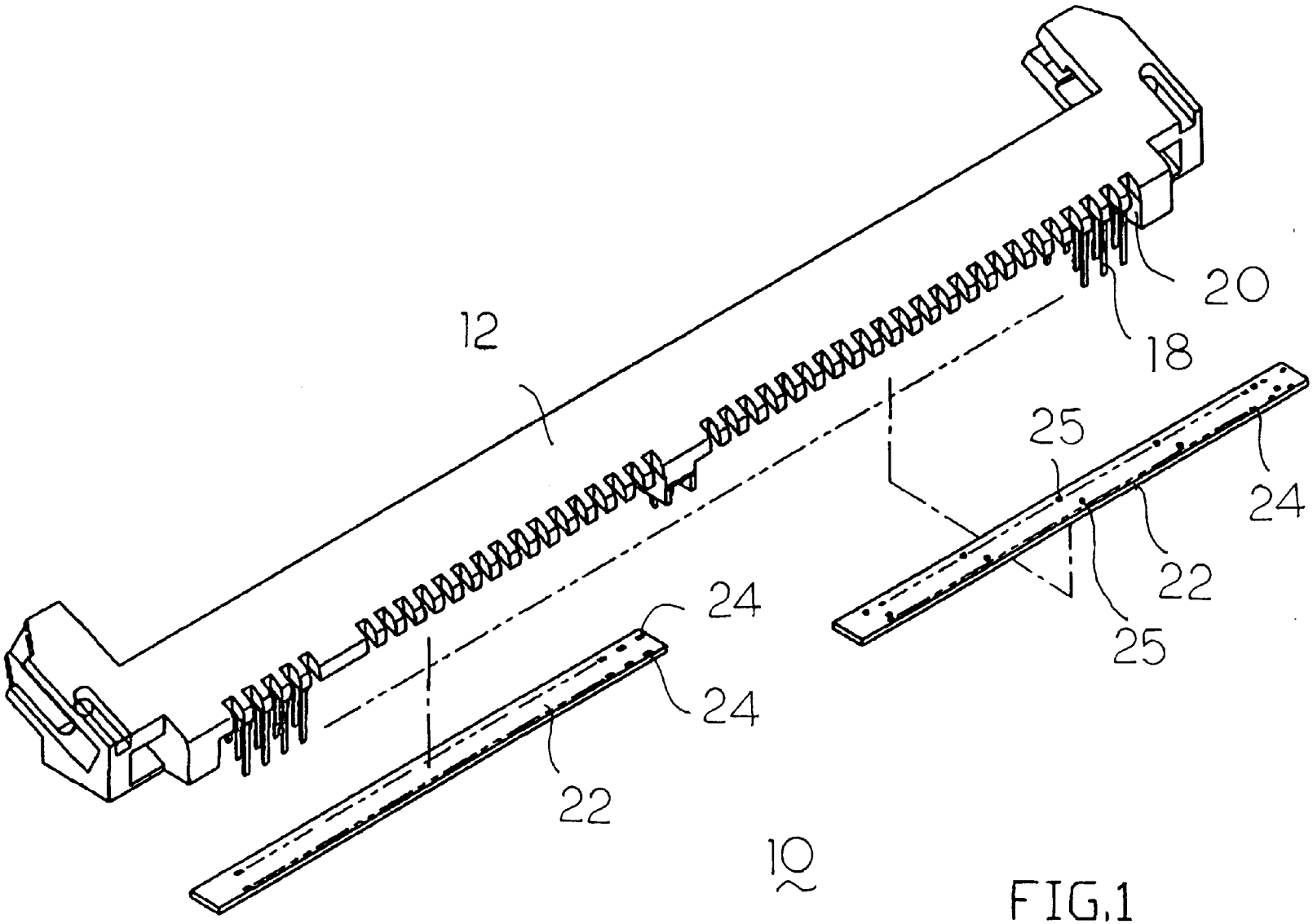
FIG. 1 is an exploded perspective view of a presently preferred embodiment of an electrical connector, without ejectors thereof at two opposite ends, according to the invention.
Figure 2:
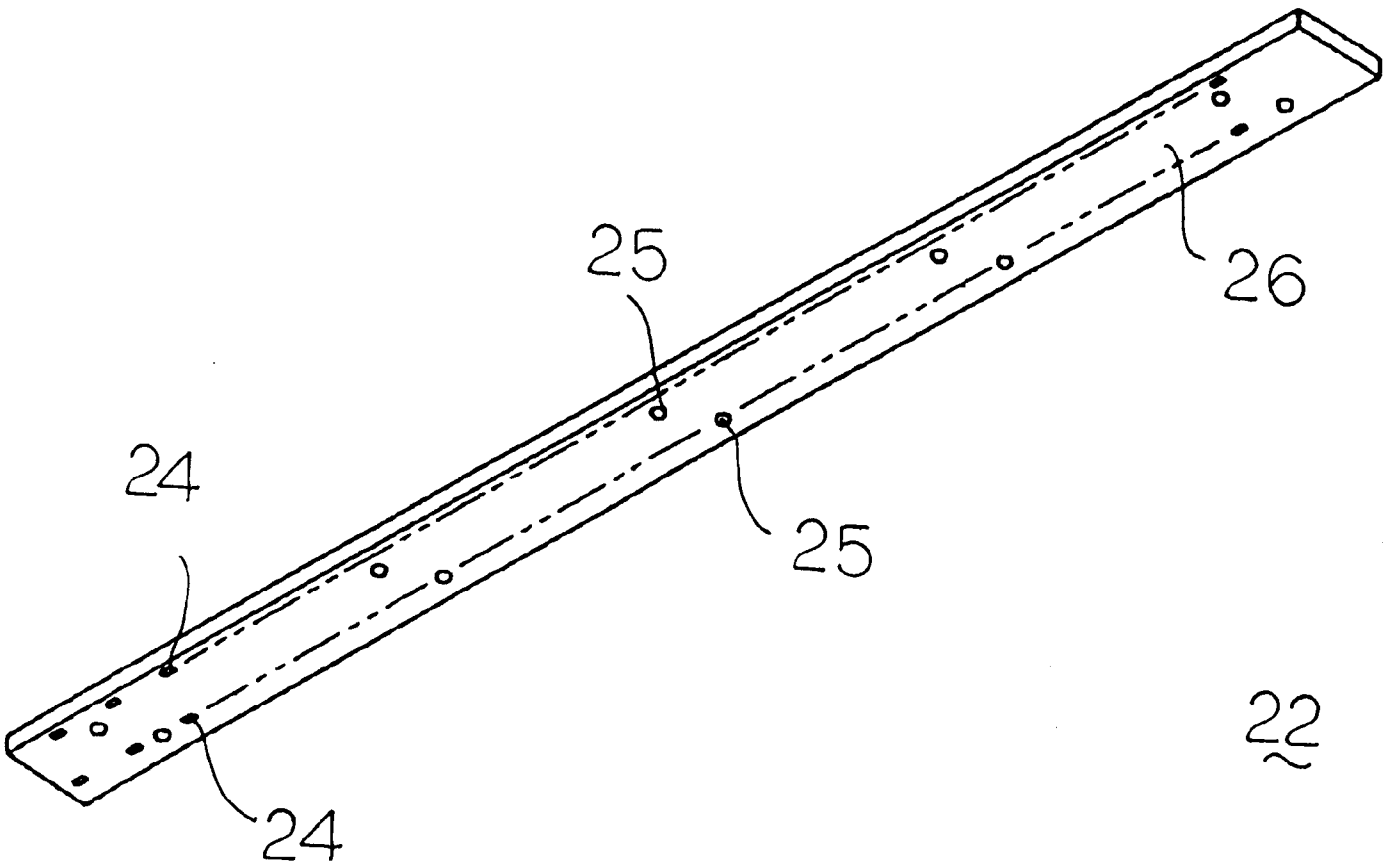
FIG. 2 an enlarged perspective view of the upside downward spacer for use with the connector of FIG. 1.
Figure 3:
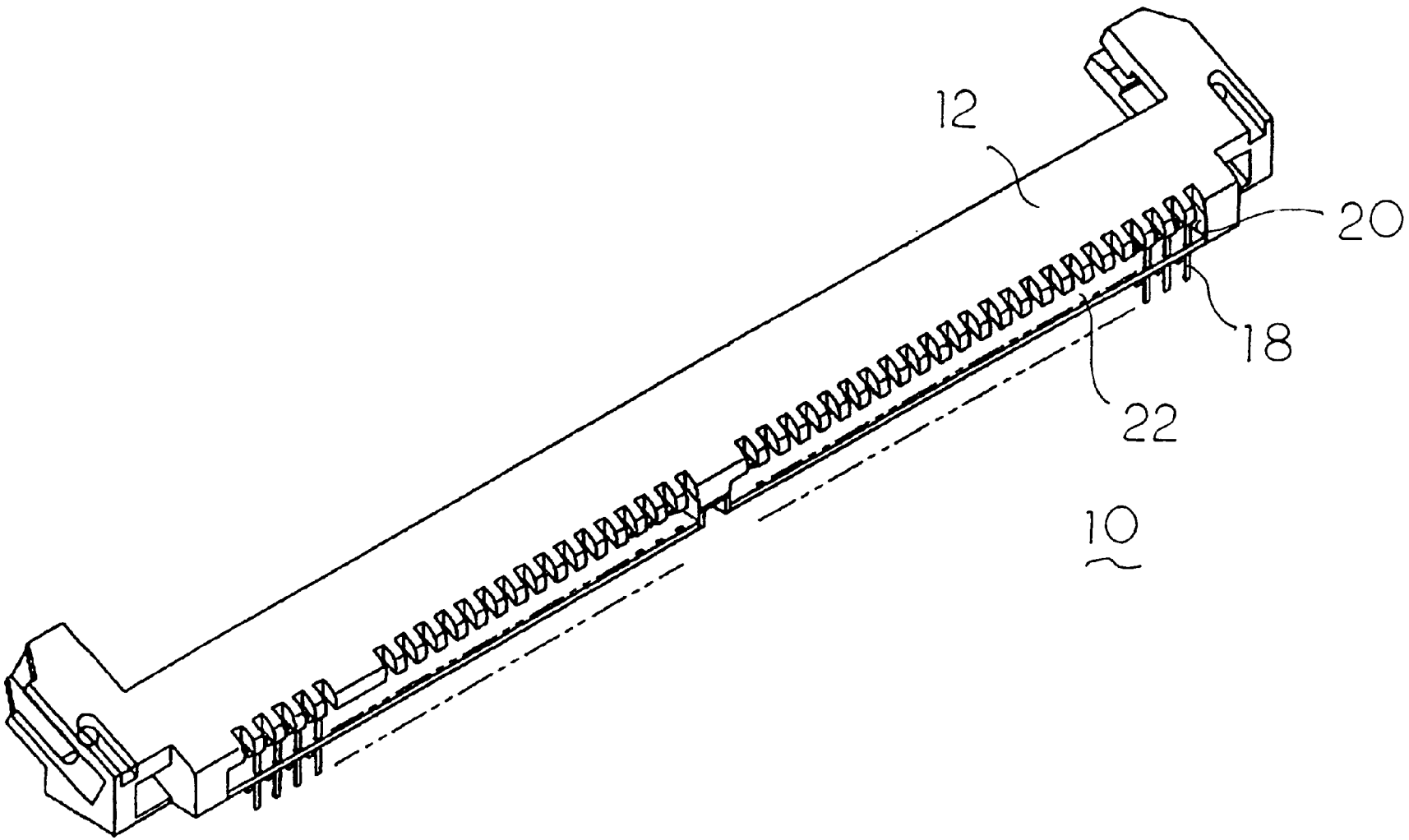
FIG. 3 is a perspective view of the assembled connector with the spacer thereof and of FIG. 1 while showing the ejector.
Figure 4:
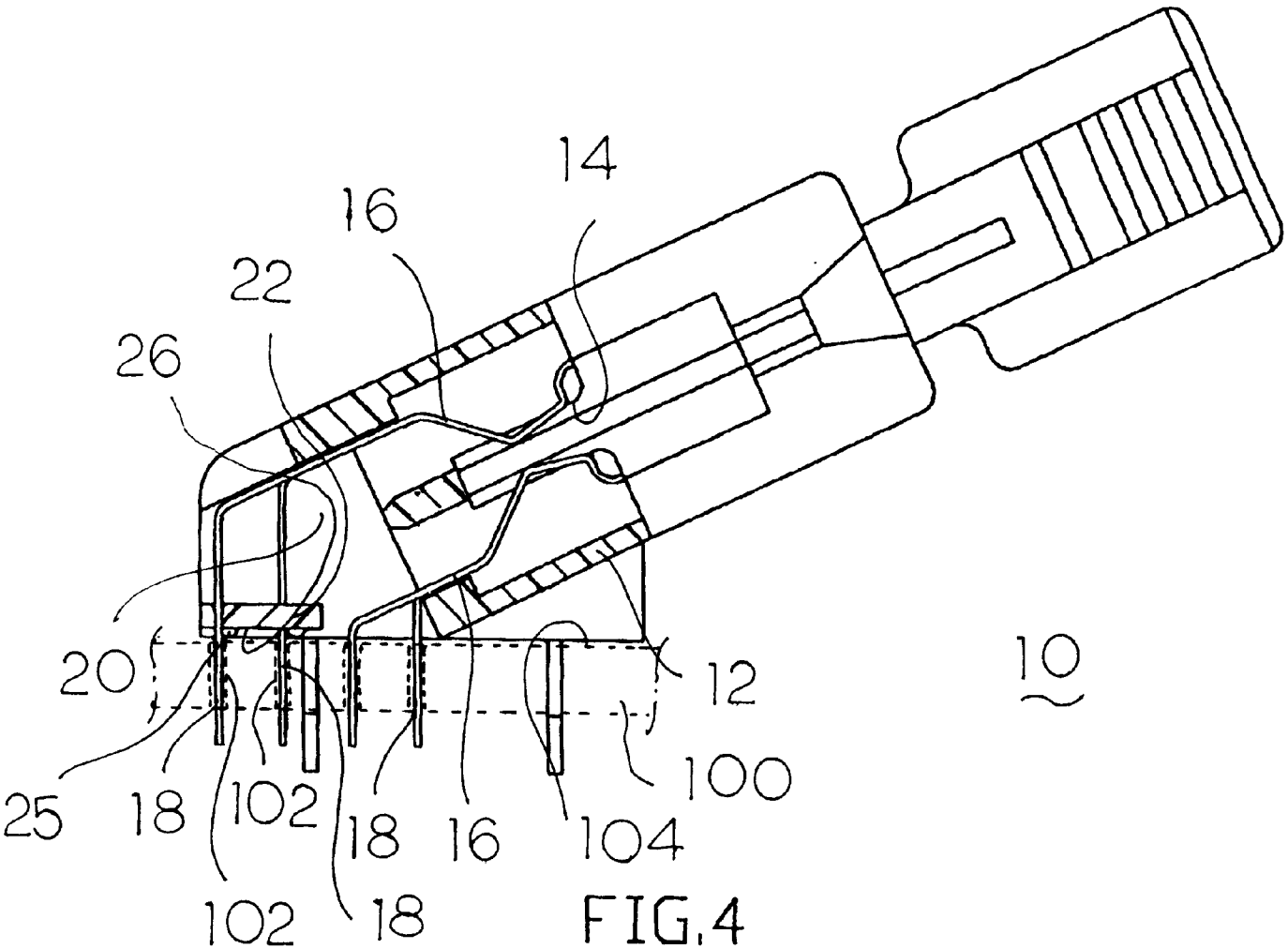
FIG. 4 is a cross-sectional view of the assembled connector of FIG. 3.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–4 wherein an electrical connector 10 includes an insulative housing 12 defining a central slot 14 (FIG. 4) for receiving a card or module (not shown) therein. A plurality of contacts 16 are disposed by two sides of the central slot 14. The contact tails 18 of the contacts 16 form four rows on the rear portion 20 of the housing 12.

Two floating spacers 22 of substantially slender and thin type, are horizontally positioned on the rear portion 20 of the housing 12. Each floating spacer 22 defines two rows of holes 24 for receivably aligning the contact tails 18, in the vertical direction, with regard to the corresponding holes 102 of the PC board 100 (FIG. 4) on which the connector 10 is seated. Each floating spacer 22 further includes plural pairs of convex bumps 25 spaced with each other in a predetermined distance on the bottom surface 26 of the spacer 22.

Therefore, when the connector 10 is seated/mounted to the PC board 100, the spacer 22 is substantially positioned on the top surface 104 of the PC board 100 wherein pairs of the convex bumps 25 provide a proper space between the bottom surface 26 of the spacer 22 and the top surface 104 of the PC board 100, so that the cleaning solution may be easily removed or drained therefrom during the soldering process.

It can be noted that the pairs of convex bumps 25 should be provided on the bottom surface 26 of the spacer 22 in proper intervals to provide the desired space thereabouts for assuring nowhere along the spacer 22 will be deflected toward to the PC board 100 due to gravity or other factors.

Figure 5:
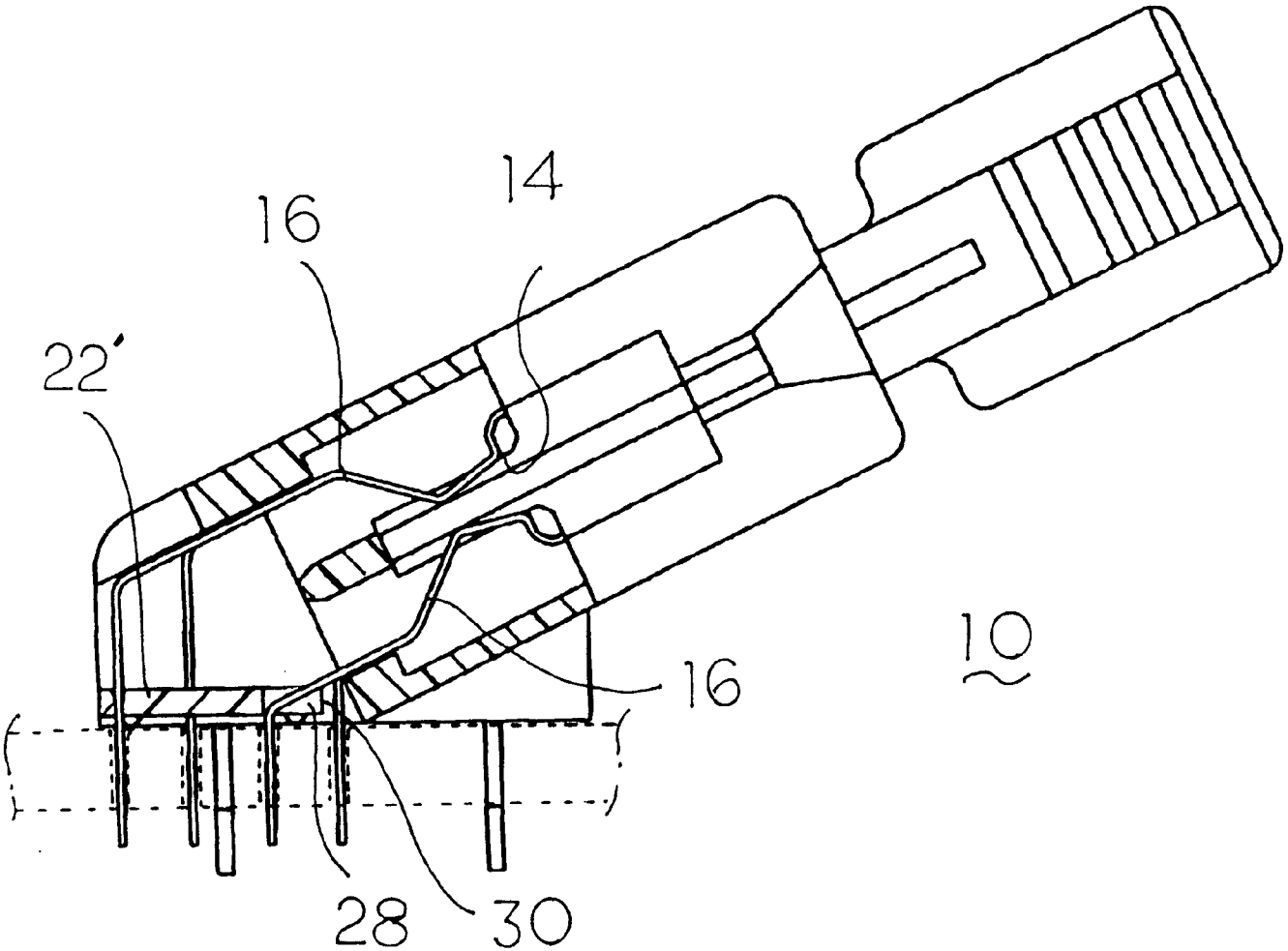
FIG. 5 is a cross-sectional view of another embodiment of an electrical connector.

FIG. 5 shows another embodiment of the invention wherein the spacer 22' further includes a plurality of notches 28 along the inner side edge 30 for further receivable aligning the third row contact tails 18 with regard to the corresponding holes in the PC board.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. An electrical slanted card edge connector for being mounted to a PC board, comprising:

an insulative housing defining a central slot with a plurality of contacts by upper and lower sides of said central slot in the housing;

said contacts defining fours rows of contact tails on a rear portion of the housing of which two rows extending from the upper side of the central slot are positioned around an outermost end of the rear portion of the housing and the remaining two rows extending from the lower side of the central slot are positioned adjacent to a middle portion of the housing; and a floating spacer provided on the rear portion of the housing for alignment of the contact tails with regard to corresponding holes in the PC board wherein the spacer includes means for providing space between a bottom surface of the spacer and a top face of the PC board; wherein a width of said spacer is dimensioned generally one half of a transverse dimension of the rear portion of the housing along a front-to-back direction and only provides two rows of alignment holes for alignment of the corresponding contact tails around the outermost end of the rear portion, whereby the spacer can be fit in an insufficient space between the connector and the PC board.

2. The connector as defined in claim 1, wherein said means includes plurality of bumps formed on the bottom surface of the spacer.

3. The connector as defined in claim 2, wherein said bumps are in a form of convex.

4. The connector as defined in claim 2, wherein said bumps are disposed in intervals along the spacer.

* * * * *